US008740760B2

(12) United States Patent
York et al.

(10) Patent No.: US 8,740,760 B2
(45) Date of Patent: Jun. 3, 2014

(54) PIVOTING TWIN ARM SUPPORT FOR FREE WEIGHTS

(71) Applicants: Ryan John York, Chicago, IL (US); Joseph Thomas Polidan, Pocomoke City, MD (US)

(72) Inventors: Ryan John York, Chicago, IL (US); Joseph Thomas Polidan, Pocomoke City, MD (US)

( * ) Notice: Subject to any disclaimer, the term of this patent is extended or adjusted under 35 U.S.C. 154(b) by 0 days.

(21) Appl. No.: 14/069,870

(22) Filed: Nov. 1, 2013

(65) Prior Publication Data

US 2014/0128229 A1 May 8, 2014

Related U.S. Application Data

(60) Provisional application No. 61/722,443, filed on Nov. 5, 2012.

(51) Int. Cl.
*A63B 21/078* (2006.01)

(52) U.S. Cl.
USPC ..... 482/104

(58) Field of Classification Search
CPC ..... A63B 21/078
USPC ..... 482/92–94, 97–100, 104, 106–108, 482/908; D21/662, 680, 681, 686, 690
See application file for complete search history.

(56) References Cited

U.S. PATENT DOCUMENTS

| | | | | |
|---|---|---|---|---|
| 2,991,485 | A * | 7/1961 | Schulte | 5/87.1 |
| 3,629,880 | A * | 12/1971 | van Rhyn | 5/83.1 |
| 5,322,489 | A * | 6/1994 | Webb et al. | 482/38 |
| 5,336,148 | A * | 8/1994 | Ish, III | 482/98 |
| 5,954,619 | A * | 9/1999 | Petrone | 482/104 |
| 8,468,622 | B2 * | 6/2013 | Purwar et al. | 5/86.1 |
| 2003/0045406 | A1 * | 3/2003 | Stone | 482/100 |
| 2005/0148445 | A1 * | 7/2005 | Carle | 482/97 |
| 2013/0296143 | A1 * | 11/2013 | Staten et al. | 482/98 |

* cited by examiner

*Primary Examiner* — Oren Ginsberg
(74) *Attorney, Agent, or Firm* — Young Basile Hanlon & MacFarlane PC

(57) ABSTRACT

An apparatus for supporting a weight lifting dumbbell includes a riser and a cradle support arm pivotally attached to the riser at a first pivot connection. The cradle support arm may be selectively rotated around the first pivot connection between a raised position and a lowered position. The apparatus may also include a cradle for supporting a free weight. The cradle is pivotally connected to the cradle support arm at a second pivot connection. Moving the cradle support arm between the raised and lowered positions causes the second pivot connection to rotate around the first pivot connection in response to the cradle support arm being rotated around the first pivot connection. The apparatus may further include a cradle actuating link pivotally connected to the riser and the cradle. The cradle actuating link operates to cause the cradle to rotate counter to the rotation of the cradle support arm.

17 Claims, 9 Drawing Sheets

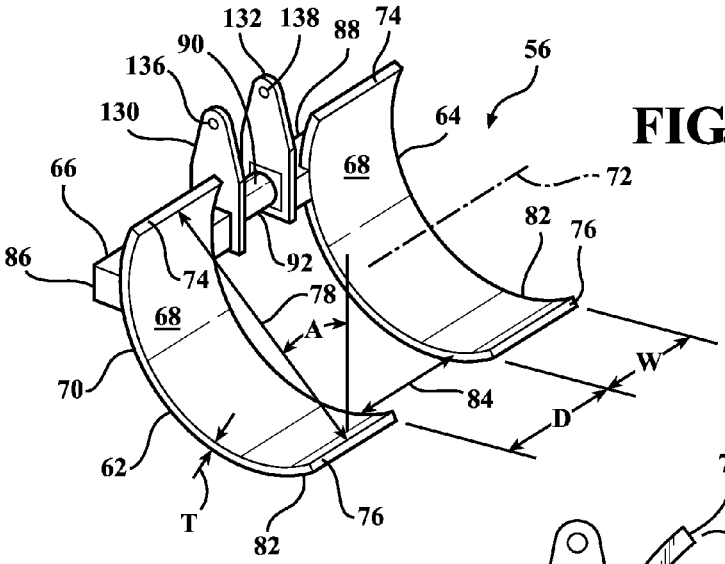
FIG. 6
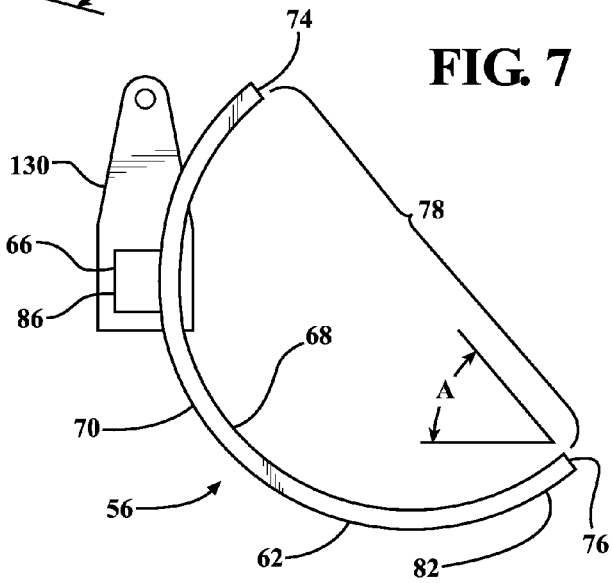
FIG. 7
FIG. 8
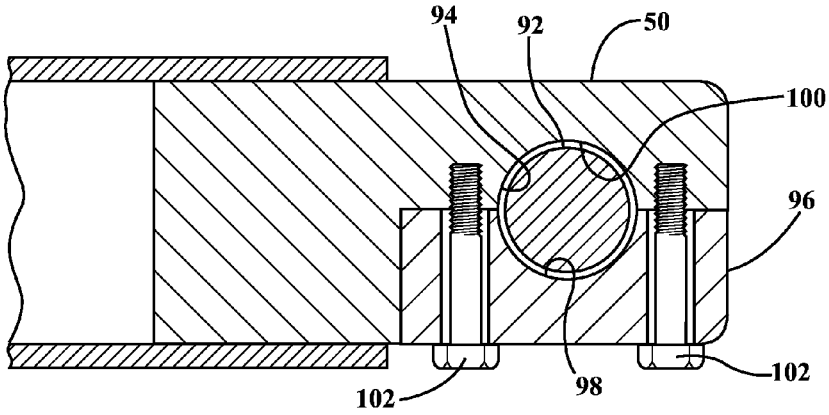

PIVOTING TWIN ARM SUPPORT FOR FREE WEIGHTS

RELATED APPLICATIONS

This application claims benefit of U.S. Provisional Application No. 61/722,443 filed on Nov. 5, 2012, which is incorporated by reference herein in its entirety.

FIELD OF THE INVENTION

The present invention pertains to exercise equipment, and more particularly, to supports for free weights used in association with weight lifting and weight lifting benches.

DESCRIPTION OF THE RELATED ART

Participants in the sport of weight lifting frequently utilize a broad range of training equipment, including a variety of free weights. Free weights are traditional barbells and dumbbells incorporating a cross-member and one or more disc-like weights removably attached too opposing ends of the cross-member. Typically, assemblies of free weights manipulated by both arms of the user are described as barbells, while smaller assemblies of cross bars and free weights manipulated by one arm are referred to as dumbbells.

Regardless of which type of free weight assembly being employed, weight lifters frequently engage in a variety of lifting exercises. In each exercise, the participant performs the exercise in a predetermined position, e.g., standing, sitting, prone or inclined. For many exercises, the participant utilizes a horizontal, inclined or declined bench or an adjustable seat during the exercise.

Whether barbells or dumbbells, the free weight assemblies used during a training or exercise session are, by design, heavy. The weight of barbell assemblies is often measured in hundreds of pounds, and individual dumbbell assemblies often exceed one hundred pounds. To enable the participant to begin and end each group of weight lifting repetitions from a desired starting point, it is desirable that the free weight assembly be safely positioned in relation to the participant, to permit the participant to correctly position himself or herself in relation to the weight assembly prior to commencing and after finishing the exercise. And, since each exercise repetition group may have different starting positions, it is useful for the free weights to be supportable in a variety of positional relationships to the participant. Further, because of the differences between the physical dimensions of individual participants, a starting position for one user may be unsuitable for another. Accordingly differences in stature among participants in the same exercise facility dictates that free weight support equipment be freely and easily adjustable.

There have been a number of solutions proposed to weight lifting support apparatus having adjustment features. For example, U.S. Pat. No. 6,149,556 issued to Jordan, discloses a multi-level dumbbell support apparatus incorporating dumbbell supports which are adjustably connected to vertical supports. U.S. Pat. No. 7,070,547, issued to Pater, discloses dumbbell supports which are secured to the frame of a weight lifter's bench. Pivotal supports are illustrated by Murray, et al., in U.S. Patent Publication No. 2007/0082795. The present invention, however, has advantages over prior configurations, in that it provides a mobile support which is freely positionable in an exercise area, and which may be positioned in advantageous relationship to a weight lifter's bench. Further, by virtue of arcuate adjustment, the present invention is positionable in a variety of angular locations in relation to the starting position of an exercise, allowing for adjustment both vertically and horizontally in relation to, for example, a weight lifter's bench.

Further, the present invention incorporates a counterweighting system, which simplifies positioning of the support while inhibiting unwanted movement.

Further, wheels or casters attached to the frame facilitate movement of the invention to different locations within the exercise room environment.

SUMMARY OF THE INVENTION

The invention is a support designed to support light and heavy weight dumbbells and barbells, while improving safety when compared to conventional lifting methods. The invention supports free weight movements from inclined and declined weight lifter's benches, as well as flat bench press exercises and shoulder press exercises. The invention relies primarily on two support arms that are adjustable in an angular fashion. The angular adjustments allow the user to easily position free weights at different elevations, giving the device greater versatility than prior configurations. The invention incorporates a pair of pivoting arms, at one end of which are disposed holders for free weights. The pivoting arms are easily adjusted to establish angle settings for positioning free weights for the appropriate position to start a particular weight lifting exercise. The invention utilizes counter weights to allow smooth and easy rotation of the arms. By providing the invention with wheels or casters, the device is mobile and can be moved between locations simply by lifting one end of the device utilizing the primary arms and rolling on casters. The invention has been optimized in width and height to be versatile in the weight training environment.

BRIEF DESCRIPTION OF THE DRAWINGS

The various features, advantages and other uses of the present apparatus will become more apparent by referring to the following detailed description and drawings in which:

FIG. 6 is a front perspective view of an exemplary dumbbell cradle employed with the pivoting dumbbell support apparatus;

FIG. 7 is a side elevation view of the dumbbell cradle;

FIG. 8 is a partial cross-sectional view taken along section line 8-8 of FIG. 4 illustrating an exemplary configured pivot connection between the dumbbell cradle and a cradle support arm employed with the pivoting dumbbell support apparatus;

DESCRIPTION OF THE PREFERRED EMBODIMENT

Figure 1:
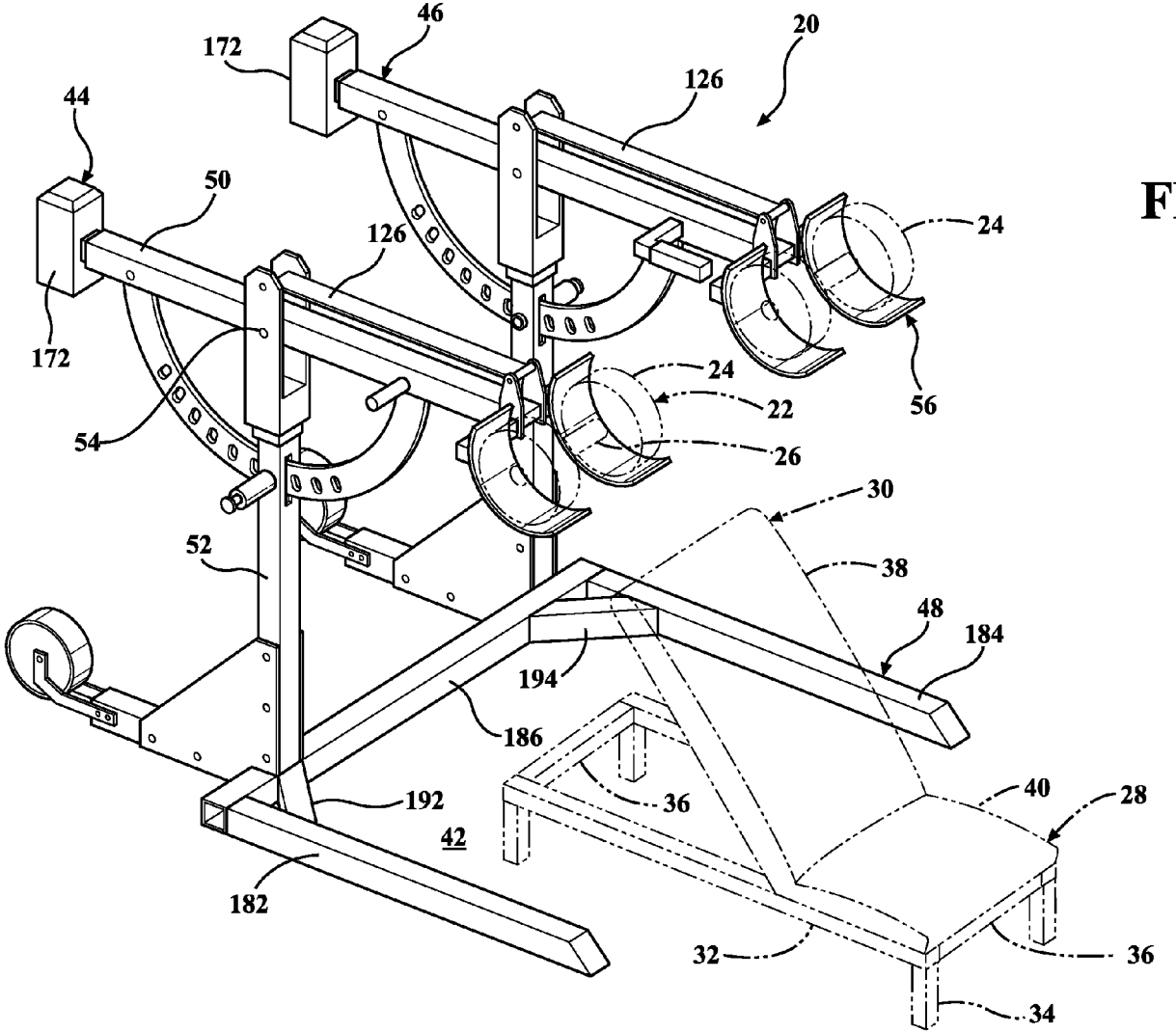
FIG. 1 is a front perspective view of an exemplary pivoting dumbbell support apparatus.

With reference to FIGS. 1-14, a free weight support apparatus 20 may be used to support a dumbbell 22 (see FIG. 1) generally consisting of one or more weight elements 24 interconnected by a cross bar 26. The free weight support apparatus 20 may be used in conjunction with a weight lifter's bench 28, or may be used by a participant in weight lifting activities that is standing or otherwise positioned in relation to a free weight to be manipulated in a weight lifting exercise. These exercises may be conducted on or near the weight lifter's bench 28.

The weight lifting bench 28 may include a support 30 for the back, hips and legs. The support 30 may be attached to a frame 32 having one or more support legs 34 and one or more cross-members 36. The support 30 may include two or more individually adjustable sections. For example, a back support 38 may provide support for the user's back and upper hip region, and a seat support 40 may support the lower hip region and legs. The back support 38 and the seat support 40 may be selectively positioned relative to one another depending on the exercise being performed. The weight lifting bench 28 may be positioned relative to the free weight support apparatus 20, and is typically permanently or movably mounted to a floor or other horizontal support 42.

With reference to FIGS. 1-5, the free weight support apparatus 20 may include a pair of selectively pivotable support assemblies 44 and 46 that may be attached to a base assembly 48. Support assemblies 44 and 46 may be configured substantially the same and include like components, and may be configured as minor opposites.

The support assemblies 44 and 46 are configured to enable a user to selectively position a dumbbell supported on the free weight support apparatus 20 in relation to the weight lifting bench and/or user. With continued reference to FIGS. 1-5, the support assemblies 44 and 46 may include a cradle support arm 50 pivotally connected to a riser 52 at a pivot connection 54. A cradle 56 configured to support the dumbbell 22 may be pivotally attached to a proximal end 58 of the cradle support arm 50 at a second pivot connection 60. The pivot connection 54 and pivot connection 60 may be spaced a substantially fixed distance from one another. The cradle support arm 50 may be selectively pivoted around the pivot connection 54 relative to the riser 52 to adjust a position of a dumbbell 22 supported on the cradle 56 relative to the user. This enables the user to position the cradle 56 at a position suitable for the exercise being performed.

With reference also to FIGS. 6 and 7, the cradle 56 may include a pair of free weight holders 62 and 64 attached to a holder mounting bracket 66. Each free weight holder 62 and 64 may be configured to support an end of the dumbbell 22, with each weight element 24 resting on a separate free weight holder, as illustrated for example, in FIG. 1. The free weight holders 62 and 64 may be similarly configured. Each may have a generally semi-cylindrical shape that includes a concave interior surface 68 for receiving the dumbbell 22 and an opposite convex exterior surface 70 that attaches to the holder mounting bracket 66. The interior surface 68 of the free weight holders 62 and 64 may be coated with a resilient material to provide cushioning between the dumbbell 24 and the support surface. The free weight holders 62 and 64 may be arranged on the holder mounting bracket 66 such that a longitudinal axis 72 of the free weight holder is positioned generally horizontal when the cradle 56 is attached to cradle support arm 50.

Opposing ends 74 and 76 of the cylindrically-shaped free weight holders 62 and 64 define an access opening 78 through which the dumbbell 22 may be placed onto the free weight holder. The free weight holders 62 and 64 may be positioned such that that the access opening 78 faces generally upward and is canted from vertical by an acute angle A. A lower end portion 82 of the free weight holders 62 and 64 may curve generally upward to aid in retaining the dumbbell 22 on the free weight holder when placed on the cradle 56.

With continued reference to FIGS. 6 and 7, a width W of the free weight holder may be sized wide enough to support dumbbell 22 positioned on the cradle 56. The width W may be greater than or less than a width of the weight element 24 of the dumbbell 22. A thickness T of the free weight holders 62 and 64 may vary depending on the composition of the material employed and the anticipated weight that may be supported on the cradle 56. The free weight holders 62 and 64 should be sufficiently thick to withstand impact forces that may result, for example, from a dumbbell being dropped on the cradle. Optional bracing, such as ribs, may be attached to the exterior surface 70 of the free weight holders 62 and 64 to enhance the strength and/or stiffness of the free weight holder.

Although illustrated as having a substantially uniform thickness T, the free weight holders 62 and 64 may also have a non-uniform thickness. It is not necessary that the exterior surface 70 and interior surface 68 of the free weight holders 62 and 64 have the same contour. The contour of the interior surface 68 and the exterior surface 70 may differ from the illustrated exemplary configuration. For example, one or both of the interior and exterior surfaces 68 and 70 may have a generally L-shaped contour when viewed from a side perspective. Other geometric shapes may also be employed.

With continued reference to FIGS. 6 and 7, the free weight holders 62 and 64 may be spaced apart a distance D to provide a gap 84 between the respective free weight holders large enough to allow a user's hand to pass through and grasp the cross bar 26 of the dumbbell 22 positioned on the cradle 56. The distance D between the free weight holders 62 and 64 may generally coincide with a distance separating the weight elements 24 of the dumbbell 22.

The holder mounting bracket 66 may be fixedly attached to the exterior surface 70 of the free weight holders 62 and 64, using various attachment mechanisms, including but not limited to, welding, brazing, bolts, screws and rivets, to name a few. The holder mounting bracket 66 may have a non-uniform cross-sectional shape, for example, as illustrated in FIG. 6, or a substantially uniform cross-sectional shape along its entire length. In the illustrated exemplary configuration, the holder mounting bracket 66 includes generally rectangular-shaped end portions 86 and 88 arranged on opposite sides of a generally cylindrical center section 90 forming a cradle connecting rod 92. Alternatively, the end portions 86 and 88 may be configured to include a different cross-sectional shape, and may employ the same cross-sectional shape as the cradle connecting rod 92. The free weight holders 62 and 64 may be attached to the end portions 86 and 88, respectively.

With reference to FIGS. 6-9, the cradle 56 may be pivotally connected to the cradle support arm 50 at the pivot connection 60. The pivot connection 60 may be formed by engaging the cradle connecting rod 92 with an aperture 94 extending through the cradle support arm 50. To facilitate assembly of the cradle 56 to the cradle support arm 50, the pivot connection 60 may include a cover 96 that attaches to the cradle support arm 50. Approximately one half 98 of the aperture 94 may be formed in the cover 96, with a remaining half 100 being formed in the cradle support arm 50. The cradle connecting rod 92 may be captured between the cradle support arm 50 and the cover 96 when the cradle 56 is mounted to the cradle support arm 50. The cover 96 may be detachably connected to the cradle support arm 50, for example, using bolts 102, or permanently connected to the cradle support arm 50, for example, by welding or brazing.

Figure 2:
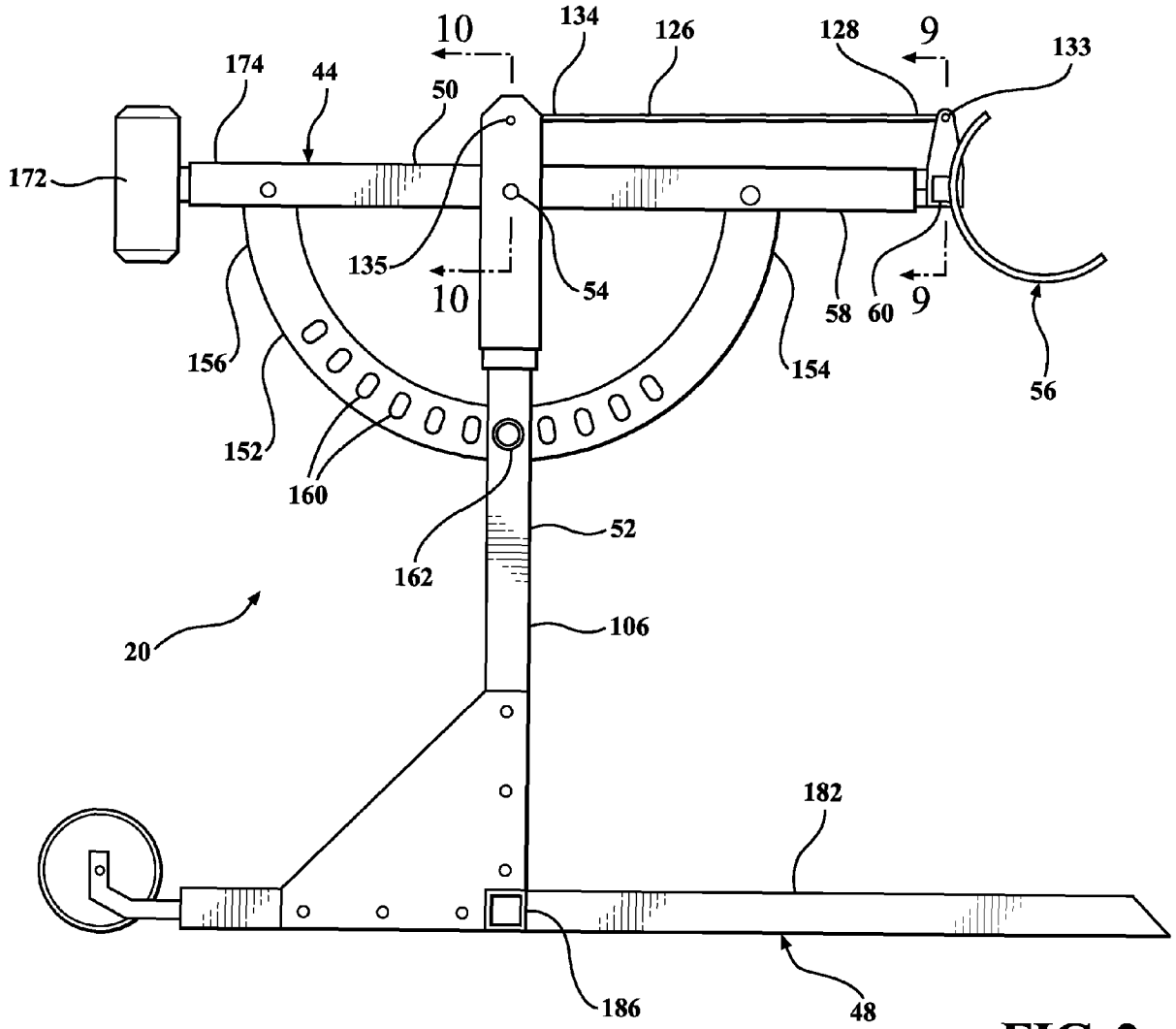
FIG. 2 is a side elevation view of the pivoting dumbbell support apparatus.
Figure 3:
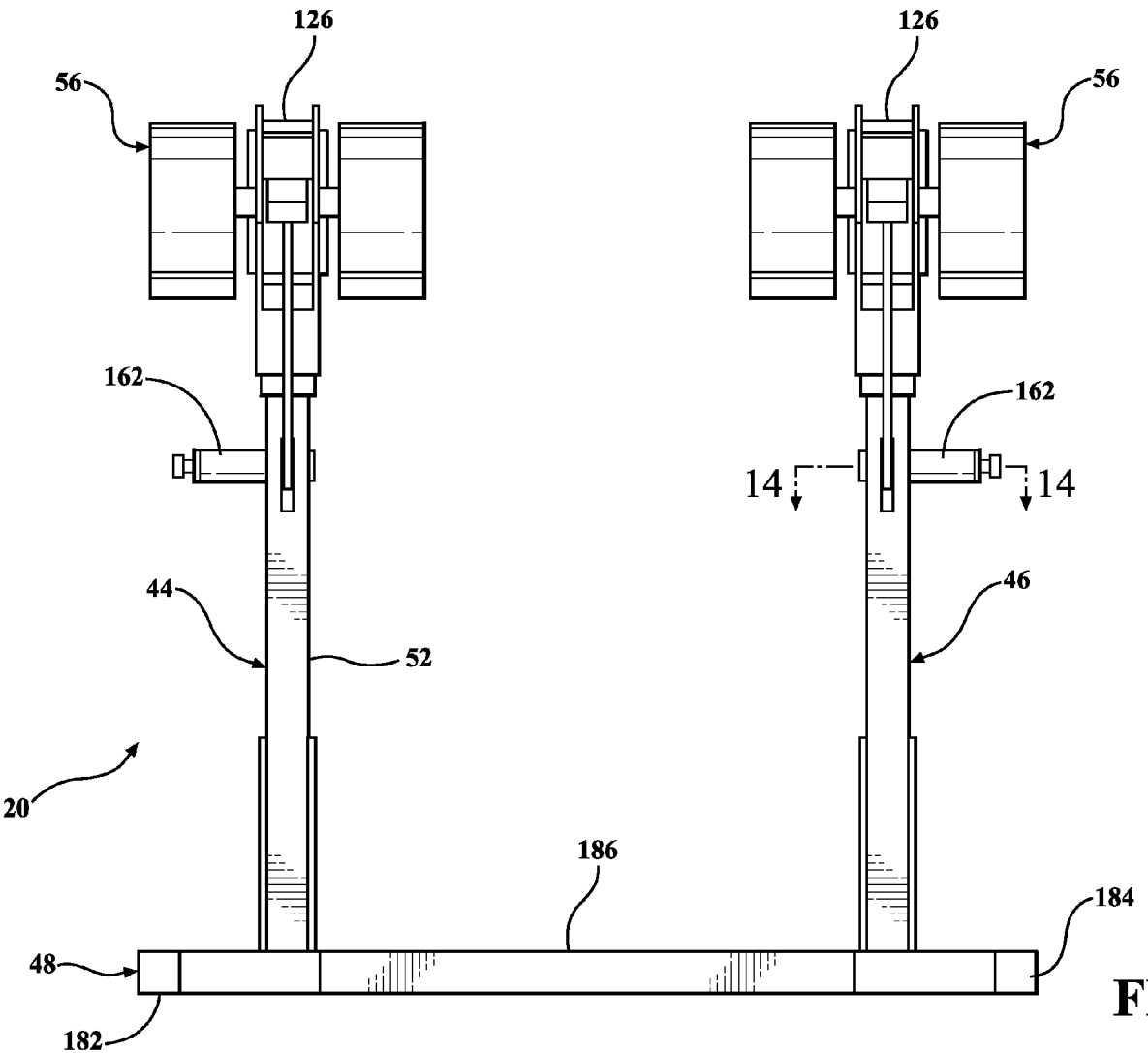
FIG. 3 is a front elevation view of the pivoting dumbbell support apparatus.
Figure 11:
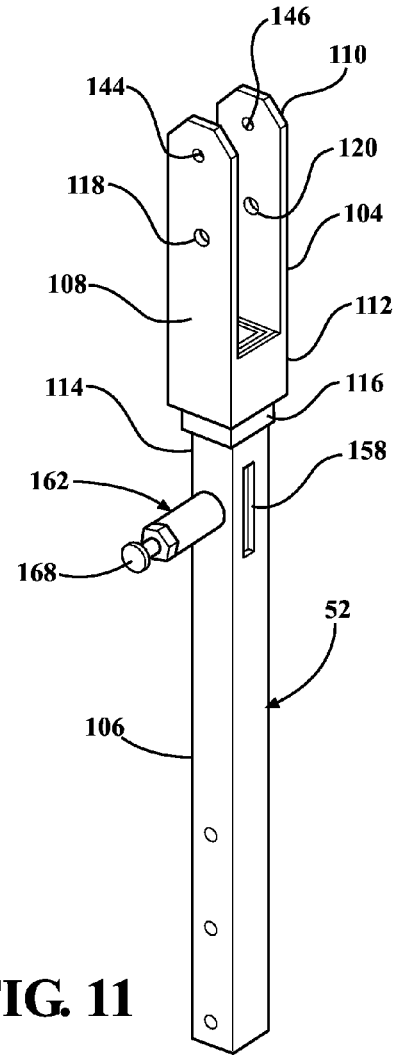
FIG. 11 is a perspective view of the riser employed with the pivoting dumbbell support apparatus.

With reference to FIGS. 2 and 11, the cradle support arm 50 may be pivotally attached to the riser 52 at pivot connection 54. The riser 52 may include a cap 104 attached to an elongated support member 106. The support member 106 may include a tubular construction and have any of a variety of cross-sectional shapes. For example, in the illustrated exemplary configuration the support member 106 has a general rectangular cross-sectional shape, but may alternatively be configured to include other geometric shapes. The support member may have a uniform cross-sectional shape, or it may vary along its length.

The cap 106 may include a pair of side plates 108 and 110 attached to a collar 112 that may be fixedly connected to an end 114 of the support member 106. Various permanent and removable connection mechanisms may employed for connecting the collar 112 to the support member 106, such as welding, brazing, and various fasteners, including, bolts, screws and rivets. One or more shims 116 may be positioned between the collar 112 and the support member 106 to accommodate a difference in size between the collar 112 and the support member 106.

Figure 10:
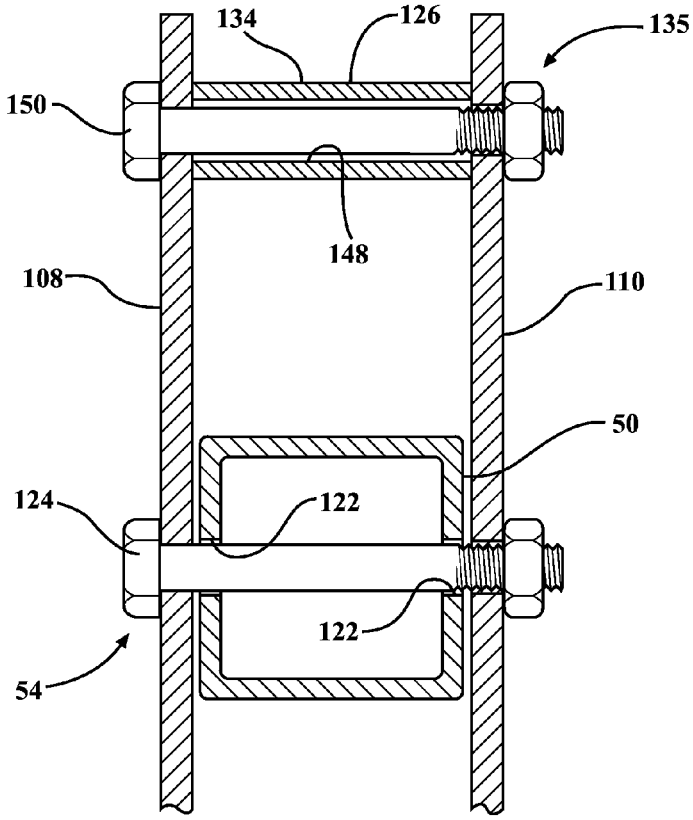
FIG. 10 is a partial cross-sectional view taken along section line 10-10 of FIG. 2 illustrating exemplary configured pivot connections between the cradle support arm and a riser employed with the pivoting dumbbell support apparatus and the cradle actuating link and the riser.

With reference to FIGS. 2, 10 and 11, the side plates 108 and 110 of the cap 104 may be spaced sufficiently apart to enable the cradle support arm 50 to be positioned between the side plates. The side plates 108 and 110 include thru apertures 118 and 120, respectively, that align with a corresponding thru aperture 122 in the cradle support arm 50. The cradle support arm 50 may be pivotably connected to the side plates 108 and 110 by engaging a fastener 124 with the apertures 118 and 120 in the side plates 108 and 110, respectively, and the aperture 122 in the cradle support arm 50. The fastener 124 may be permanently or detachably connected to the side plates 108 and 110, and may include bolts, screws, rivets and pins, as well as other attachment mechanisms. The pivot connection 54 is configured to allow the cradle support arm 50 to be rotated around a longitudinal axis of the fastener 124.

With reference to FIGS. 2, 6 and 7, an elongated cradle actuating link 126 may be employed to synchronize pivoting of the cradle 56 around the second pivot connection 60 with pivoting of the cradle support arm 50 around the pivot connection 54. The cradle actuating link 126 may have a proximal end 128 pivotally attached to a pair of cradle pivot links 130 and 132 at a pivot connection 133. The cradle pivot links 130 and 132 may be fixedly attached to the holder mounting bracket 66 of the cradle 56. An opposite distal end 134 may be pivotally attached to the side plates 108 and 110 of the riser 52 at a pivot connection 135. Pivot connection 135 may be positioned in a substantially fixed relation to pivot connection 54. The pivot connection 133 and pivot connection 135 may be spaced a substantially fixed distance from one another. The spacing between pivot connection 133 and pivot connection 135 may be substantially equal to the spacing between pivot connection 54 and pivot connection 60. The pivot connection 60 and the pivot connection 133 may be spaced a substantially fixed distance from one another.

With reference to FIGS. 6, 7, 9 and 10, the cradle pivot links 130 and 132 may be fixedly connected to the free weight holders 62 and 64 by way of the holder mounting bracket 66 for concurrent rotation therewith around the second pivot connection 60. The cradle pivot links 130 and 132 include apertures 136 and 138, respectively, which align with a corresponding aperture 140 extending thru the proximal end 128 of the cradle actuating link 126. A fastener 142 extends through the apertures 136 and 138 in the cradle pivot links 130 and 132 and the aperture 140 in the cradle actuating link 126 to pivotally connect the cradle actuating link 126 to the cradle pivot links 130 and 132. Similarly, the side plates 108 and 110 may include apertures 144 and 146, respectively, which align with a corresponding aperture 148 extending thru the distal end 134 of the cradle actuating link 126. A fastener 150 may extend through the apertures 144 and 146 in the side plates 108 and 110, respectively, and the aperture 148 in the cradle actuating link 126 to pivotally connect the cradle actuating link 126 to the side plates 108 and 110.

Figure 13:
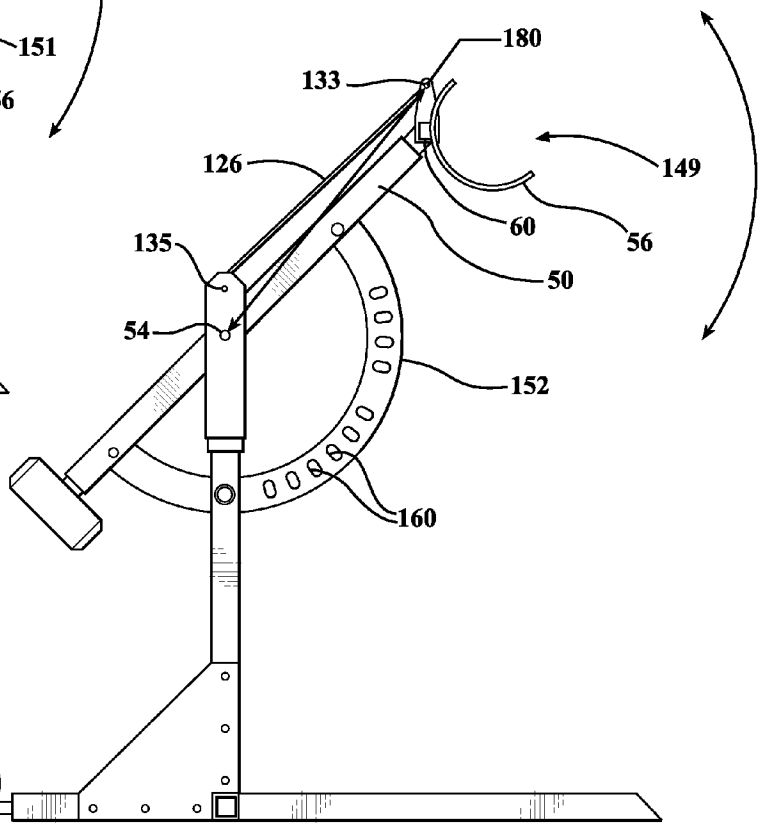
FIG. 13 is a side elevation view of the pivoting dumbbell support apparatus illustrating the cradle support arm pivoted into a raised position.
Figure 12:
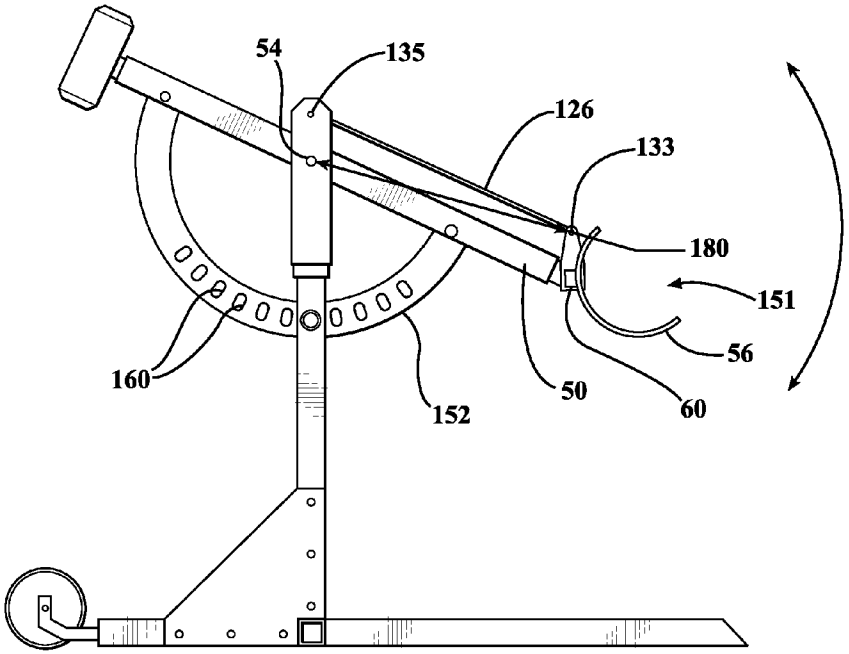
FIG. 12 is a side elevation view of the pivoting dumbbell support apparatus illustrating the cradle support arm pivoted into a lowered position.

With reference to FIGS. 12 and 13, the cradle support arm 50 may be rotated around the pivot connection 54 between a raised position 149, for example, as illustrated in FIG. 13), and a lowered position 151, for example, as illustrated in FIG. 12. The pivot connection 60 connecting the cradle 56 to the cradle support arm 50 may be rotated concurrently with the cradle support arm 50 around the pivot connection 54. Rotating the cradle support arm 50 around the pivot connection 54 causes a distance 180 between pivot connection 133 and pivot connection 54 to vary, resulting in a corresponding rotation of the cradle 56 around the pivot connection 60. The distance between pivot connection 54 and pivot connection 133 is greater when the cradle support arm 50 is arranged in the raised position 149 than when arranged in the lowered position 151. Arranging the cradle actuating link 126 and the pivot connections 133 and 135 on a common side of the cradle support arm 50 causes the cradle 56 and cradle support arm 50 to rotate in opposite directions around their respective pivot connections. For example, rotating the cradle support arm toward the raised position 149 (i.e., counter-clockwise from the perspective of FIG. 12) causes a corresponding clockwise rotation (as viewed from the perspective of FIGS. 12 and 13) of the cradle 56 around the pivot connection 60. On the other hand, rotating the cradle support arm 50 toward the lowered position 151 (i.e., clockwise from the perspective of FIGS. 12 and 13) causes a corresponding counter-clockwise rotation (as viewed from the perspective of FIGS. 12 and 13) of the cradle 56 around the pivot connection 60. This counter-rotating feature allows the orientation of the cradle 56 to remain generally fixed as the cradle support arm 50 is moved between the raised position 149 and lowered position 151.

Figure 5:
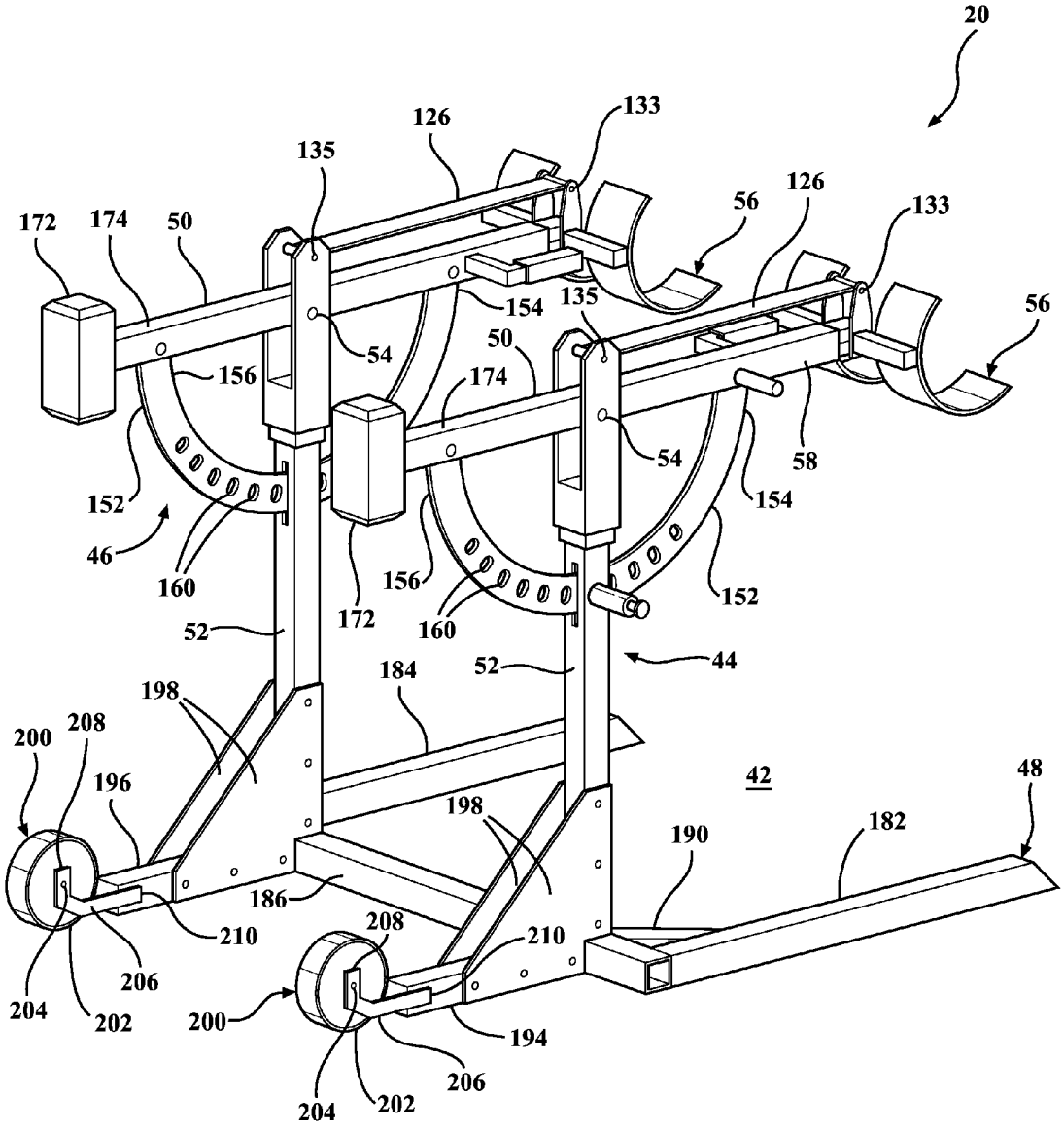
FIG. 5 is a rear perspective view of the pivoting dumbbell support apparatus.
Figure 9:
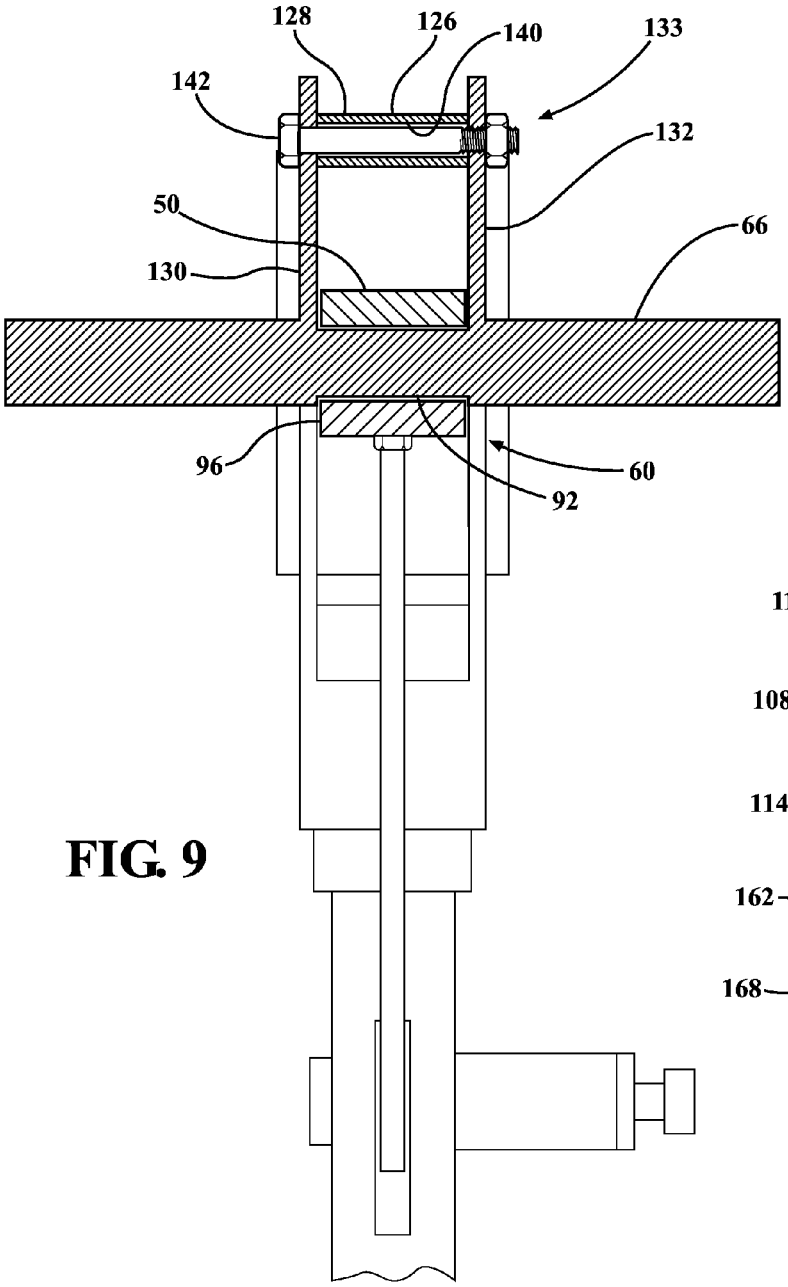
FIG. 9 is a partial cross-sectional view taken along section line 9-9 of FIG. 2 illustrating the pivot connection between the dumbbell cradle and the cradle support arm and an exemplary configured pivot connection between the cradle and a cradle actuating link employed with the pivoting dumbbell support apparatus.

With reference to FIGS. 2, 5 and 11, the free weight support apparatus may include a position selector 152 for releasably maintaining the cradle support arm 50 in one or more selected angular orientations relative to the riser 52. The position selector 152 may be configured as an elongated curved member having at least one end 154 attached to the cradle support arm 50 for concurrent movement therewith. An opposite second end 156 of the position selector 152 may also be connected to the cradle support arm 50. The pivot connection 54 is located between the ends 154 and 156 of the position selector 152 when both ends are attached to the cradle support arm 50, for example, as illustrated in FIG. 2.

Figure 14:
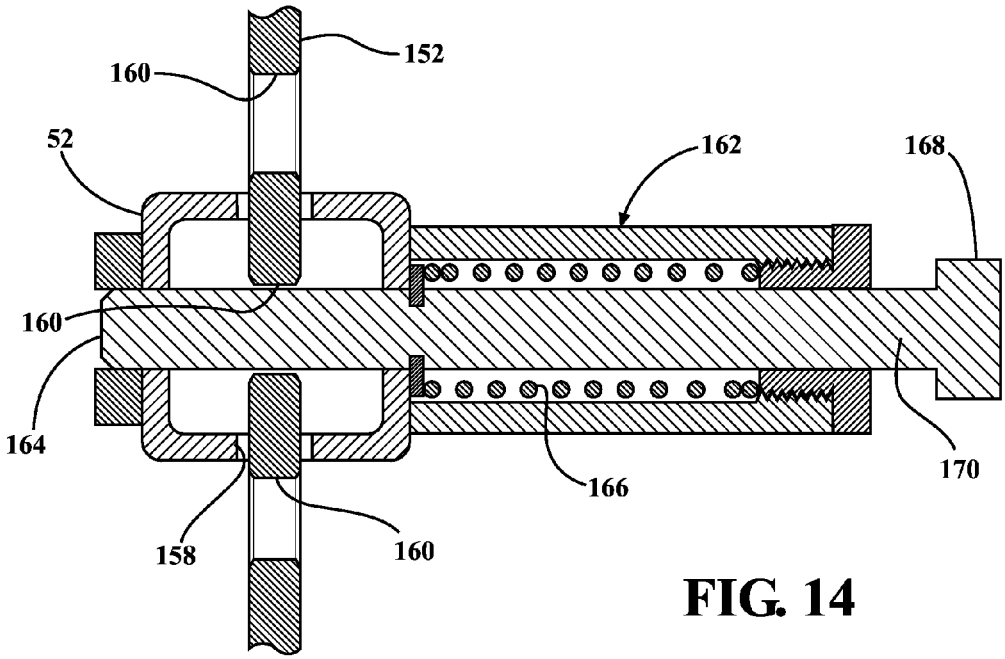
FIG. 14 is a partial cross-sectional view taken along section line 14-14 of FIG. 3 illustrating a locking pin operable for maintaining a selected angular position of the cradle support arm relative to the rise.

With reference to FIGS. 2, 11 and 14, the riser 52 may include a thru slot 158 for slidably receiving the position selector 152. The position selector 152 may include multiple indexing apertures or indentations 160 disposed at various locations along a length of the position selector 152. A locking mechanism 162 may be attached to the riser 52. The locking mechanism 162 may include a movable locking pin 164 that may selectively engage the indexing apertures 160 in the position selector 152. A biasing member 166, for example, a coil spring, may be employed to urge the locking pin 164 toward the position selector 152 and into engagement with one of the indexing apertures 160. A locking pin handle 168 accessible to a user may be attached to an end 170 of the locking pin 164.

The angular orientation of the cradle support arm 50 relative to the riser 52 may be adjusted by disengaging the locking pin 164 from the indexing aperture 160. This may be accomplished by grasping the locking pin handle 168 and pulling the locking pin 164 away from the position selector 152 to withdraw the locking pin 164 from the indexing aperture 160. The cradle support arm 50 may then be rotated around the pivot connection 54 to a desired position. Releasing the locking pin handle 168 allows the biasing member 166 to move the locking pin 164 into engagement with a corresponding indexing aperture 160 in the position selector 152, thereby maintaining the cradle support arm 50 in the selected angular orientation.

With reference to FIG. 5, to facilitate adjusting the angular position of the cradle support arm 50 a counter weight 172 may be attached to a distal end 174 of the cradle support arm 50. The counter weight 172 and the cradle 56 are located on opposite sides of the pivot connection 54. The counter weight 172 may be sized to have approximately same weight as the cradle 56, so that when no weight is resting on the cradle 56 the cradle support arm 50 is substantially in balance, thereby facilitating selective pivoting movement of the cradle support arm 50 around the pivot connection 54.

Figure 4:
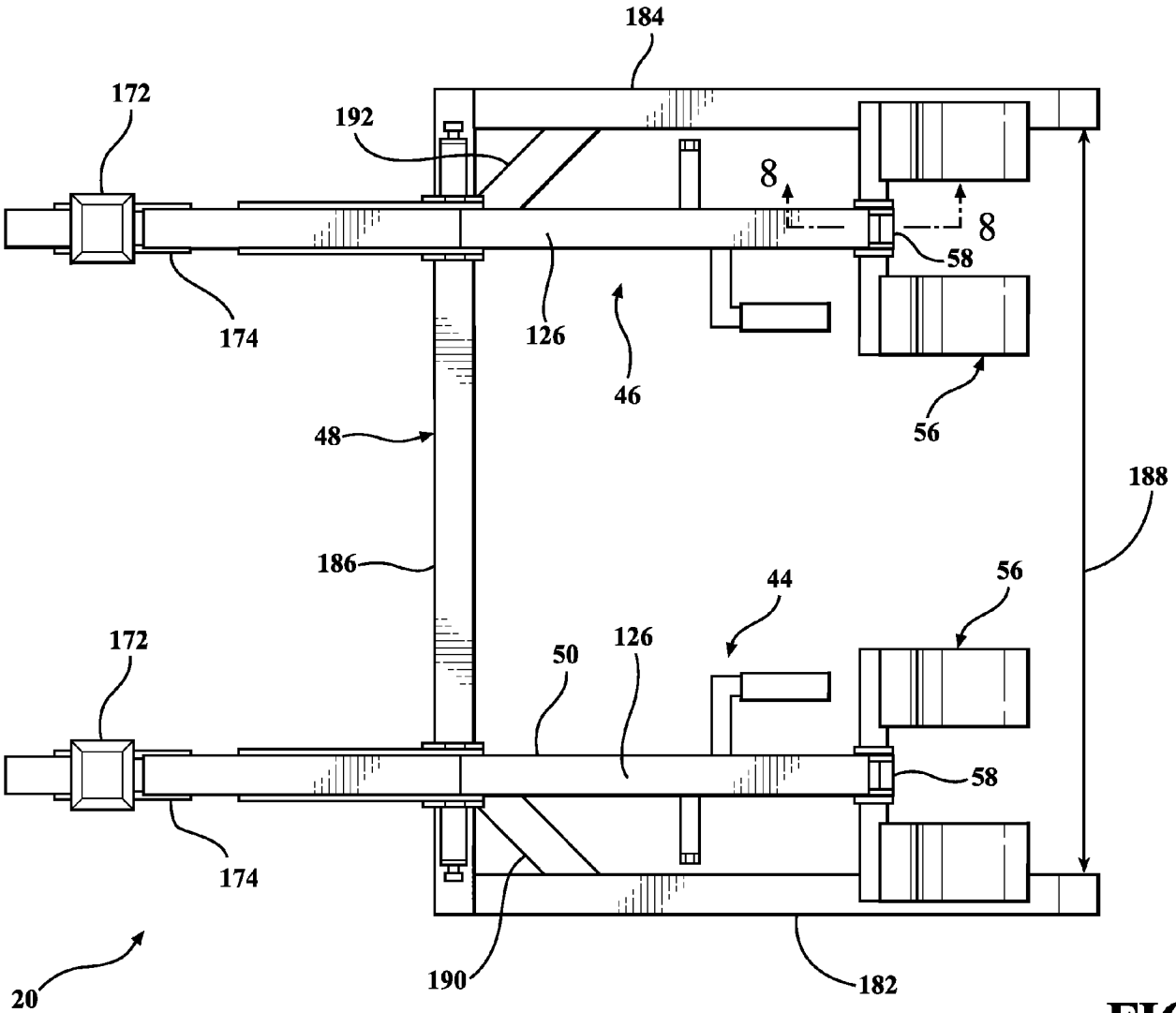
FIG. 4 is a top plan view of the pivoting dumbbell support apparatus.

With reference to FIGS. 4 and 5, the riser 52 of the free weight support assemblies 44 and 46 may be affixed to the base assembly 48. The base assembly 48 may include a pair of spaced apart legs 182 and 184 interconnected by a cross member 186 for supporting the base assembly 48 on the floor 42 or another surface. The spaced apart legs 182 and 184 provide a gap 188 between legs 182 and 184 that allows the free weight support apparatus 20 to be readily positioned in relation to the weight lifter's bench 28 without needing to attach the assembly to the bench. Spacing apart the legs 182 and 184 also facilitates repositioning of the free weight support apparatus 20 in relation to the bench 28. To provide rigidity, stiffeners 190 and 192 may interconnect portions of the legs 182 and 184 and cross member 186.

With particular reference to FIG. 5, the base assembly 48 may also include a second pair of legs 194 and 196 attached to the cross member 186 on a side opposite the side to which the legs 182 and 184 are attached. One or more braces 198 may interconnect the riser 52 to the second pair of legs 194 and 196 to provide support for the support assemblies 44 and 46 and help maintain alignment of the riser 52 relative to the base assembly 48.

To facilitate transporting and positioning the free weight support apparatus 20, one or more wheel assemblies or casters 200 may be affixed to the second pair of legs 194 and 196. Each wheel assembly 200 may include a wheel 202 rotatably mounted on an axle 204. One or more wheel mounting brackets 206 may be used to connect the wheel assemblies 200 to the legs 194 and 196 of the base assembly 48. One end 208 of the wheel mounting bracket 206 may be attached to the axle 204 and an opposite end 210 may be attached to one of the legs 194 and 196.

The device so described promotes an optimal level of exercise since the user does not have to waste energy carrying free weights while preparing for the specific exercise repetition and its associated movement. The device further promotes safety for both the user and other patrons of the exercise facility. Further, the device reduces the chances for undesired muscular strain associated with lifting of the weights for movement to different locations in the exercise facility. The device further reduces the risk associated with uncontrolled dropping of weights on the floor or other equipment.

The scope of the invention should be determined by the appended claims and their legal equivalents, and not limited to the specific examples given. While recited characteristics and conditions of the invention have been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An apparatus for supporting a weight lifting dumbbell, the apparatus comprising:

a riser;

a cradle support arm pivotally attached to the riser at a first pivot connection, the cradle support arm selectively rotatable around the first pivot connection between a raised position and a lowered position; and a cradle for supporting the dumbbell, the cradle pivotally connected to the cradle support arm at a second pivot connection, wherein the second pivot connection is rotatable around the first pivot connection in response to the cradle support arm being rotated around the first pivot connection, the cradle comprises a cradle pivot link pivotally connected to the second pivot connection and a free weight holder fixedly attached to the cradle pivot link for concurrent rotation therewith, the apparatus further comprising a cradle actuating link pivotally attached to a third pivot connection positioned in substantially fixed relation to the first pivot connection, the cradle actuating link and the cradle pivot link pivotally connected, a counter weight attached to the cradle support arm, wherein the cradle and the counter weight are arranged on opposite sides of the first pivot connection.

2. The apparatus of claim 1, wherein the cradle support arm rotates around the first pivot connection in a first direction and the cradle rotates around the second pivot connection in an opposite second direction when the cradle support arm is pivoted between the raised and lowered positions.

3. The apparatus of claim 1, wherein the riser includes the third pivot connection.

4. The apparatus of claim 1, wherein the third pivot connection and the pivot connection between the cradle actuating link and the cradle pivot link are arranged adjacent a common side of the cradle support arm.

5. The apparatus of claim 1, wherein the first pivot connection is spaced a first distance from the pivot connection between the cradle actuating link and the cradle pivot link when the cradle support arm is arranged in the raised position and spaced a second distance when the cradle support arm is arranged in the lowered position, the first distance being greater than the second distance.

6. The apparatus of claim 1 further comprising a position selector attached to the cradle support arm for concurrent movement therewith, the position selector selectively connectable to the riser at one or more locations along a length of the position selector.

7. The apparatus of claim 6 further comprising a locking mechanism fixedly attached to the riser and selectively engageable with the position selector.

8. The apparatus of claim 1, wherein a distance between the first and second pivot connections remains substantially constant as the cradle support arm is pivoted between the raised and lowered positions.

9. The apparatus of claim 1, wherein the cradle includes at least two dumbbell holders in spaced relation to one another for supporting the dumbbell.

10. An apparatus for supporting a weight lifting dumbbell, the apparatus comprising:

a riser;

a cradle support arm pivotally attached to the riser at a first pivot connection;

a cradle for supporting the dumbbell, the cradle pivotally connected to the support arm at a second pivot connection, the cradle including a cradle pivot link; and a cradle actuating link having a distal end pivotally attached to a third pivot connection positioned in substantially fixed relation to the first pivot connection and a proximal end pivotally connected to the cradle pivot link, wherein rotating the cradle support arm around the first pivot connection causes a corresponding rotation of the cradle in an opposite direction around the second pivot connection, a counter weight attached to the cradle support arm, wherein the first pivot connection is arranged between the cradle and the counter weight.

11. The apparatus of claim 10, wherein the second pivot connection is spaced at a substantially fixed distance from the first pivot connection and the third pivot connection is spaced a substantially fixed distance from the pivot connection between the cradle actuating link and the cradle pivot link.

12. The apparatus of claim 11, wherein the distance between the first and second pivot connections is substantially equal to the distance between the third pivot connection and the pivot connection between the cradle actuating link and the cradle pivot link.

13. The apparatus of claim 11, wherein the second pivot connection is spaced at a substantially fixed distance from the pivot connection between the cradle actuating link and the cradle pivot link.

14. The apparatus of claim 11, wherein the first pivot connection is spaced a variable distance from the pivot connection between the cradle actuating link and the cradle pivot link.

15. The apparatus of claim 10 further comprising a position selector attached to the cradle support arm for concurrent movement therewith, the position selector selectively connectable to the riser at one or more locations along a length of the position selector.

16. The apparatus of claim 15 further comprising a locking mechanism fixedly attached to the riser and selectively engageable with the position selector.

17. The apparatus of claim 10, wherein the cradle comprises at least one free weight holder fixedly attached to the cradle pivot link for concurrent rotation therewith.

* * * * *